US009163509B2

(12) United States Patent
White, Jr.

(10) Patent No.: US 9,163,509 B2
(45) Date of Patent: Oct. 20, 2015

(54) GEROTOR DEVICE ROLLER POCKET GEOMETRY

(71) Applicant: White Drive Products, Inc., Hopkinsville, KY (US)

(72) Inventor: Hollis N. White, Jr., Hopkinsville, KY (US)

(73) Assignee: WHITE DRIVE PRODUCTS, INC., Hopkinsville, KY (US)

( * ) Notice: Subject to any disclaimer, the term of this patent is extended or adjusted under 35 U.S.C. 154(b) by 214 days.

(21) Appl. No.: 14/047,311

(22) Filed: Oct. 7, 2013

(65) Prior Publication Data

US 2014/0037487 A1 Feb. 6, 2014

Related U.S. Application Data

(63) Continuation-in-part of application No. PCT/US2012/040835, filed on Jun. 5, 2012, which is a continuation of application No. 13/193,946, filed on Jul. 29, 2011, now Pat. No. 8,678,795.

(51) Int. Cl.
*F01C 21/10* (2006.01)
*F01C 1/02* (2006.01)
(Continued)

(52) U.S. Cl.
CPC ..... *F01C 21/106* (2013.01); *B24B 19/06* (2013.01); *F01C 1/22* (2013.01); *F04C 2/086* (2013.01); *F04C 2/103* (2013.01); *F04C 2/084* (2013.01); *F04C 2230/10* (2013.01)

(58) Field of Classification Search
CPC ..... F01C 1/22; F01C 21/106; F04C 2/086
USPC ..... 418/150, 61.3, 171, 166, 225, 128, 249
See application file for complete search history.

(56) References Cited

U.S. PATENT DOCUMENTS 3,438,156 A 4/1969 Lasko
3,563,679 A 2/1971 Richardson
(Continued)

FOREIGN PATENT DOCUMENTS

| | | |
|---|---|---|
| DE | 2421304 | 11/1974 |
| GB | 1219081 | 1/1971 |
| WO | 2012/058527 | 5/2012 |

OTHER PUBLICATIONS

Extended European Search Report filed in EP 12819585 mailed Feb. 6, 2015.
(Continued)

*Primary Examiner* — Kenneth Bomberg
*Assistant Examiner* — Deming Wan
(74) *Attorney, Agent, or Firm* — Rankin, Hill & Clark LLP

(57) ABSTRACT

A gerotor device includes a rotor having outwardly extending teeth and a stator having inwardly extending teeth. The inwardly extending teeth are formed by rollers each of which is received in a respective roller pocket in the stator. Each roller pocket has a maximum pocket width measured perpendicular to a pocket centerline. Each roller pocket defines a roller bearing surface having a first side that follows a first radius and a second side on an opposite side of the centerline that follows a second radius. Each radius is greater than ½ the maximum pocket width. Each roller pocket has an edge pocket width between a first pocket edge where the pocket transitions to a generally cylindrical section in the stator and a second pocket edge on an opposite side of the centerline. The edge pocket width is less than the maximum pocket width.

13 Claims, 3 Drawing Sheets

(51) Int. Cl.

| | |
|---|---|
| ***F01C 1/063*** | (2006.01) |
| ***F03C 2/00*** | (2006.01) |
| ***F04C 2/00*** | (2006.01) |
| ***F04C 18/00*** | (2006.01) |
| ***F16N 13/20*** | (2006.01) |
| ***B24B 19/06*** | (2006.01) |
| ***F04C 2/08*** | (2006.01) |
| ***F04C 2/10*** | (2006.01) |
| ***F01C 1/22*** | (2006.01) |

(56) References Cited

U.S. PATENT DOCUMENTS

| | | | | |
|---|---|---|---|---|
| 3,591,320 | A | 7/1971 | Woodling | |
| 3,930,766 | A * | 1/1976 | Swedberg | 418/61.3 |
| 4,008,015 | A * | 2/1977 | McDermott | 418/61.3 |
| 4,058,938 | A | 11/1977 | Harle et al. | |
| 4,087,215 | A | 5/1978 | Miller | |
| 4,170,851 | A | 10/1979 | Enos | |
| 4,394,112 | A * | 7/1983 | Woodling | 418/61.3 |
| 4,592,173 | A | 6/1986 | White | |
| 4,859,160 | A | 8/1989 | White | |
| 5,030,072 | A | 7/1991 | Wenker | |
| 5,595,479 | A | 1/1997 | Hansen et al. | |
| 7,431,635 | B2 | 10/2008 | Dong et al. | |
| 7,481,633 | B2 | 1/2009 | White | |
| 7,726,958 | B2 | 6/2010 | Pedersen et al. | |
| 8,221,102 | B2 | 7/2012 | Pedersen et al. | |
| 2002/0159905 | A1 * | 10/2002 | Bachmann et al. | 418/61.3 |
| 2007/0134119 | A1 | 6/2007 | Pedersen et al. | |

OTHER PUBLICATIONS

International Search Report filed in PCT/US2012/040835.

* cited by examiner

GEROTOR DEVICE ROLLER POCKET GEOMETRY

BACKGROUND

A hydraulic gerotor device includes a stator having internal teeth and a rotor having external teeth. The rotor is mounted eccentrically within the stator. There is one more internal tooth on the stator than external teeth on the rotor. The internal teeth of the stator can be formed by cylindrical rollers, which can rotate to reduce wear in the gerotor device between the rotor and the stator.

The cylindrical rollers fit into roller pockets found in the stator. Pressurized chambers are formed between the rollers and the rotor. About one half of the chambers are filled with hydraulic fluid under high pressure and the remaining half are filled with hydraulic fluid under lower pressure. The engagement between the rollers and the rotor must provide sealing at two positions; namely, at the two points of separation between a high-pressure chamber and an adjacent low-pressure chamber.

One point of separation between the high-pressure and low-pressure chambers is formed by one roller contacting the peak of an external tooth of the rotor. This roller is subjected to an especially high loading. This roller is not only pressed into its pocket by the rotor, but also the pressure of the high-pressure chamber acts on the roller. In this situation, in some known gerotor devices the bearing surface area between the roller and the pocket is diminished so that a higher pressure is exerted on the roller. This higher pressure can be detrimental and can lead undesirable impressions being made in the roller or on the external tooth of the stator because the roller may no longer be rotating. This resultant wear over time impairs the sealing ability of the gerotor device

SUMMARY OF THE INVENTION

In view of the foregoing, a gerotor device is provided. The gerotor device includes a rotor having outwardly extending teeth and a stator having inwardly extending teeth. The inwardly extending teeth are formed by rollers each of which is received in a respective roller pocket in the stator. The rotor forms pressure chambers with the rollers. Each roller pocket has a maximum pocket width measured perpendicular to a pocket centerline. Each roller pocket defines a roller bearing surface having a first side that follows a first radius and a second side on an opposite side of the centerline that follows a second radius. Each radius is greater than ½ the maximum pocket width. Each roller pocket has an edge pocket width measured parallel with the maximum pocket width between a first pocket edge where the pocket transitions to a central cavity in the stator and a second pocket edge where the pocket transitions to the central cavity in the stator on an opposite side of the centerline. The edge pocket width is less than the maximum pocket width.

DETAILED DESCRIPTION

Figure 1:
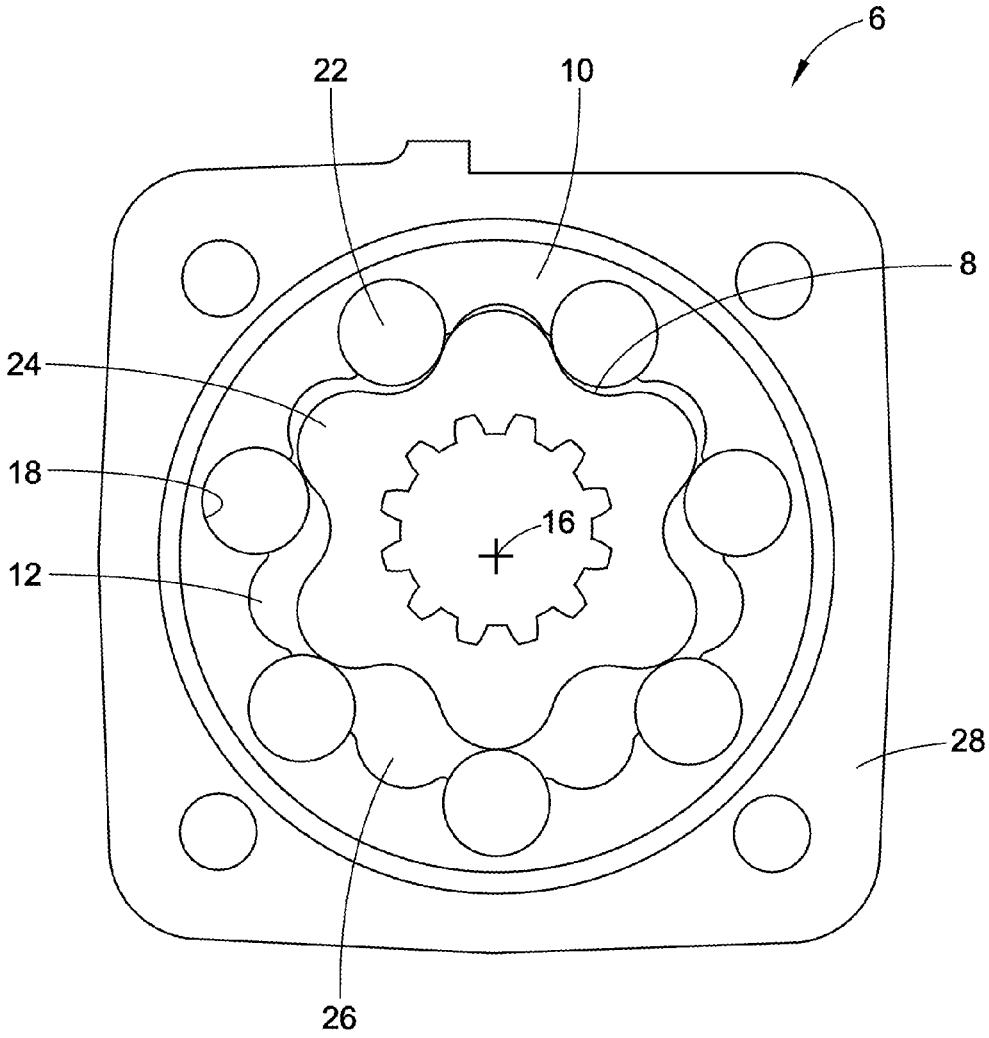
FIG. 1 depicts a rotor and stator for a gerotor device.

FIG. 1 shows a hydraulic gerotor device 6 including a rotor 8 and a stator 10. The stator 10 is provided with a central cavity 12 centered with respect to a central axis 16 of the stator and a plurality of roller pockets 18 around a periphery of the central cavity 12. Each roller pocket 18 is configured to receive a respective roller 22. Each roller 22 acts as an internal tooth of the gerotor device 6. The roller pockets 18 are angularly spaced from one another around the periphery of the cavity 12.

The stator 10 acts as an internally-toothed member that eccentrically receives the externally-toothed rotor 8. The rotor 8 is known in the gerotor arts. The rotor 8 has one less external tooth 24 than the internal teeth (rollers 22) of the stator 10 to define a number of fluid chambers 26, which expand and contract upon the orbital and rotational movement of the rotor 8 within the stator 10. The stator 10 includes a forward face 28 and a rear face (not visible in FIG. 1) opposite the forward face. Each of the forward face 28 and the rear face are generally planar and normal to the central axis 16 of the stator 10 to promote a fluid tight seal with other components of a machine that includes the gerotor device.

Figure 2:
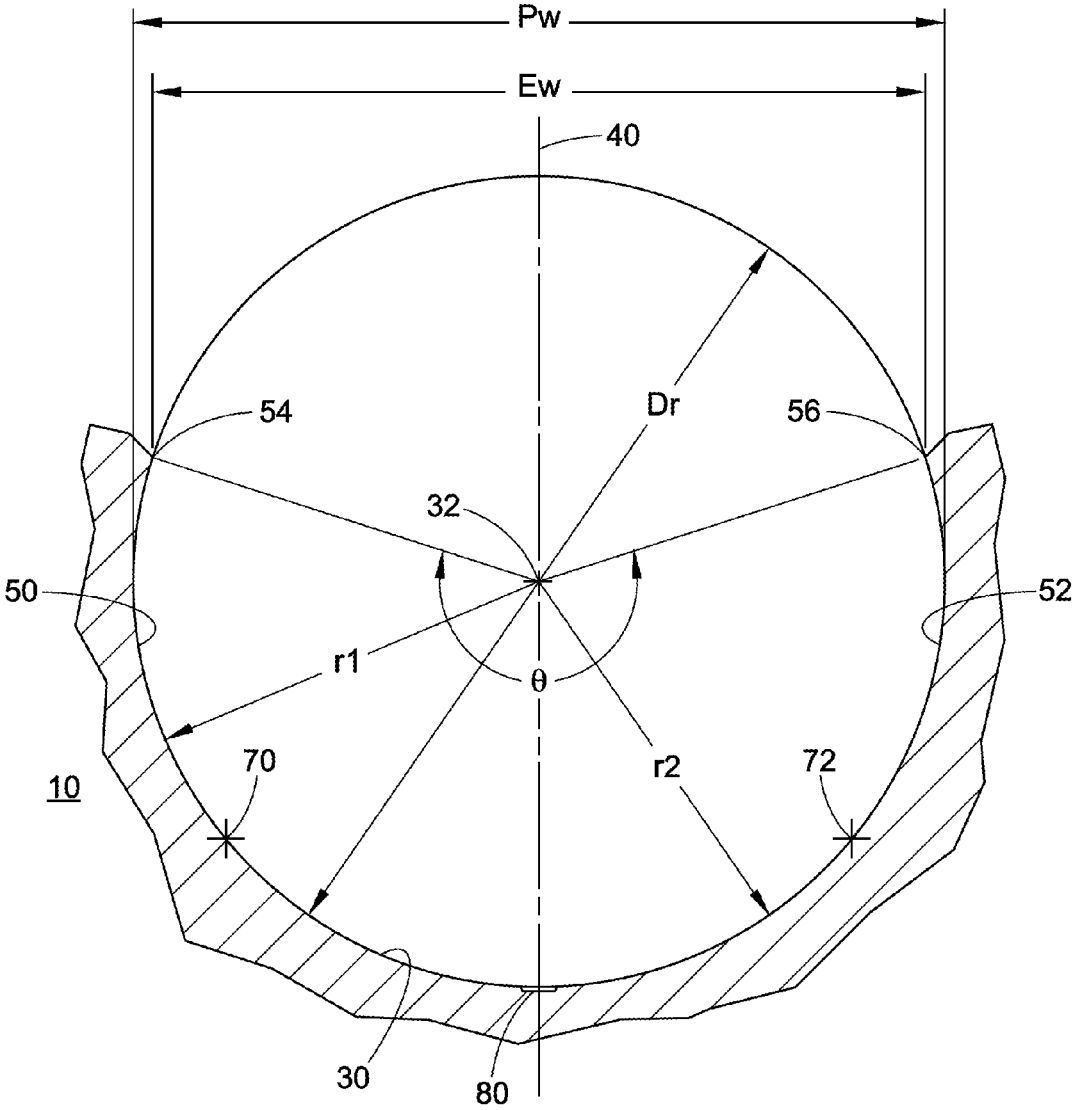
FIG. 2 is an enlarged view of the roller in the six o'clock position for the stator of FIG. 1.

With reference to FIG. 2, each roller pocket 18 includes a generally cylindrical roller pocket bearing surface 30. The respective roller 22 received in the roller pocket 18 bears against the roller pocket bearing surface 30. Each roller pocket bearing surface 30 extends along an arc depicted in FIG. 2 by angle θ. The arc, and thus roller pocket 22 and the bearing surface 30, partially surrounds the respective roller 22 received in the respective roller pocket 18. The arc, as represented by the angle θ in FIG. 2, can be greater than about 180° with respect to a nominal center point 32 of the respective roller pocket 18. More particularly, each bearing surface 30 can extend along an arc greater than 185° or 190° with respect to the nominal center point 32 of the respective roller pocket 18. Even more particularly, each bearing surface 30 can extend along an arc between about 185° and about 220° with respect to the nominal center point 32 of the respective roller pocket 18. Extending the arc of the bearing surface 30 beyond 180° provides a circumferentially longer bearing surface for the roller 22 as compared to known stators. A larger bearing surface provides an advantage in that a smaller diameter roller is able to withstand greater pressures because the pressure exerted on the roller 22 by the rotor is distributed across a greater surface area, as compared to a roller that is received in a typical roller pocket, which extends along an arc of 180°.

Each roller pocket 18 defines a pocket centerline 40 which intersects the nominal center point 32 of each roller pocket 18 and the central axis 16 (FIG. 1) of the stator 10. Each roller pocket 18 has a maximum pocket width Pw measured perpendicular to the pocket centerline 40. Each roller pocket 18 defines the roller bearing surface 30 having a first side 50 that follows a first radius r1 and a second side 52 on an opposite side of the centerline 40 that follows a second radius r2. Each radius r1, r2 is greater than ½ the maximum pocket width Pw. Each roller pocket 18 has an edge pocket width Ew measured parallel with the maximum pocket width Pw. The edge pocket width Ew is measured between a first pocket edge 54 where the roller pocket 18 transitions to the central cavity 12 in the stator 10 and a second pocket edge 56 where the roller pocket transitions to the central cavity 12 on an opposite side of the centerline 40. The edge pocket width Ew is less than the maximum pocket width Pw. The edge pocket width Ew is also less than the diameter Dr of the respective roller 22 received in the roller pocket 18. Accordingly, the respective roller 22 does not fall out of the roller pocket 18 when the rotor 8 is not received within the stator 10.

The diameter Dr of the roller 22 is very similar to, although not the same as, the maximum pocket width Pw and twice each of the first radius r1 and the second radius r2. The diameter Dr of the roller 22 is smaller than the maximum pocket width Pw. The diameter Dr of the roller 22 is also smaller than twice the first radius r1, and the diameter Dr of the roller 22 is also smaller than twice the second radius r2. The maximum pocket width Pw is smaller than twice the first radius r1, and the maximum pocket width Pw is also smaller than twice the second radius r2. For example, the maximum pocket width Pw in the illustrated embodiment is 0.4995-0.4997 inches, the diameter Dr of the roller is 0.4992-0.4994 inches and the pocket radius is 0.2502-0.2503 inches.

Figure 3:
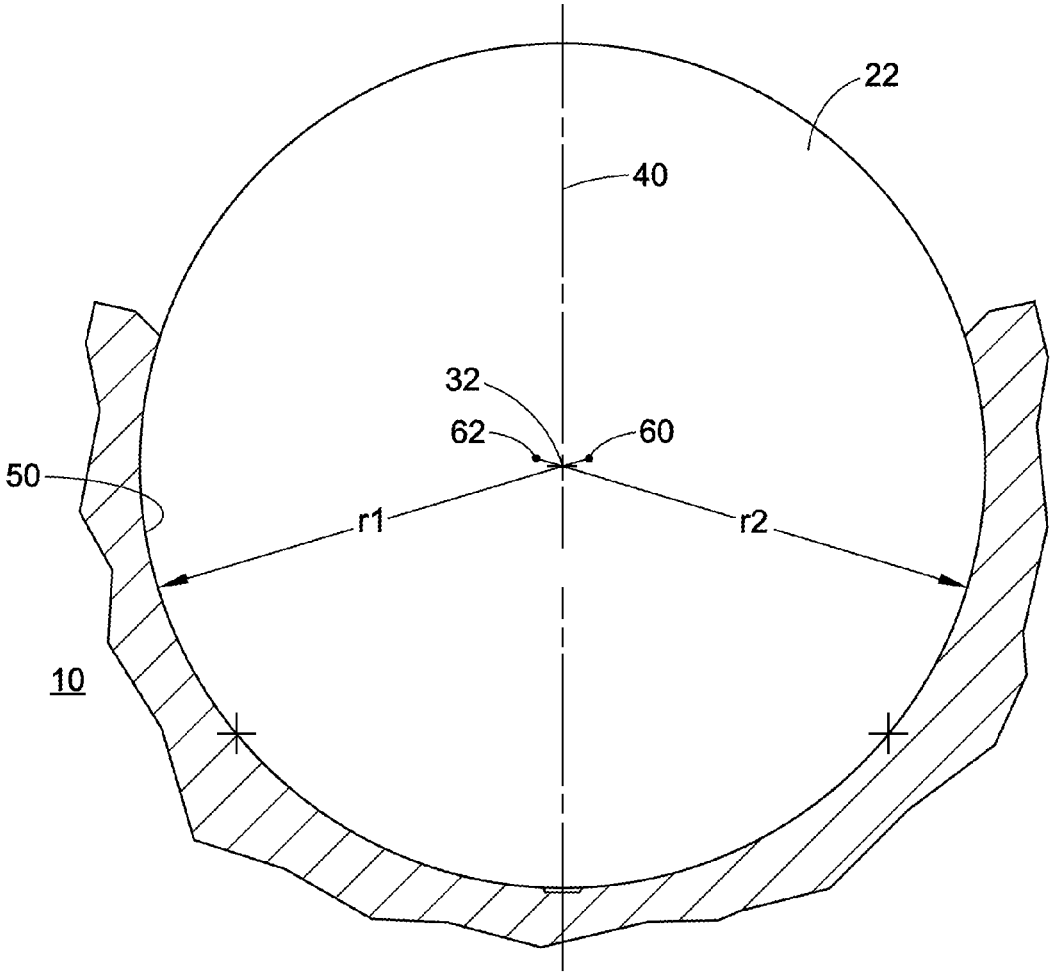
FIG. 3 is the same view of FIG. 2 showing exaggerated radii.

FIG. 3 depicts the radii r1, r2 in an exaggerated manner. The first radius r1 emanates from a first point 60 in the roller pocket 18 on an opposite side of the centerline 40 as the first side 50 of the roller bearing surface 30. The second radius r2 emanates from a second point 62 in the roller pocket 18 on an opposite side of the centerline 40 as the second side 52 of the roller bearing surface 30. In the illustrated embodiment, the first radius r1 and the second radius r2 are equal. FIG. 2 depicts the roller 22 in the roller pocket 18 in the position as if the peak of an external tooth 24 (not shown in FIG. 2) of the rotor 8 is contacting the roller 22 to provide a point of separation at the centerline 40 between a high-pressure chamber and a low-pressure chamber. When at this instant, which can be referred to as top dead center with respect to the roller 22 shown in FIG. 2, the diameter of the roller 22 and each radius r1, r2 of the roller pocket 18 is dimensioned such that the roller 22 contacts the roller bearing surface 30 at two contact points: a first contact point 70 on a first side of the centerline 40 and a second contact point 72 on a second side of the centerline.

Figure 4:
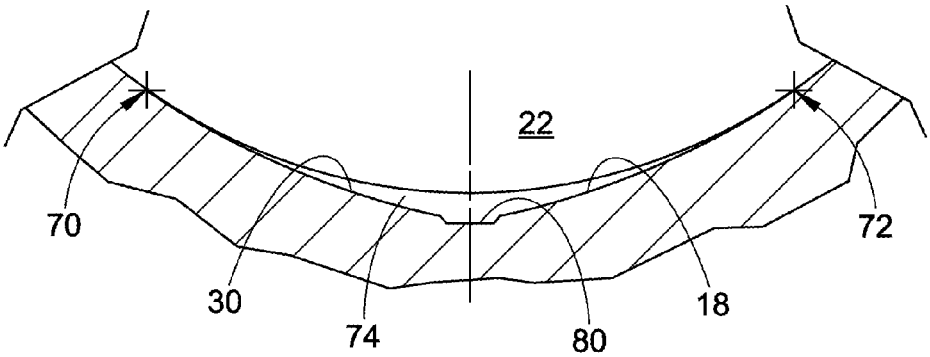
FIG. 4 shows the roller and roller pocket of FIGS. 2 and 3 with the roller bearing surface being exaggerated.

As can be more clearly seen in FIG. 4, due to the configuration of the roller 22 and the roller pocket 18, a gap 74 is provided between the roller bearing surface 30 and the roller 22 between the first contact point 70 and the second contact point 72. The roller 22 has an axial length that is less than the axial length of the stator 10. This can allow pressurized fluid from the high-pressure chamber to migrate across the planar face of the roller 22 and into the gap 74. Also, slight movement of the roller 22 within the roller pocket 18 can also allow high-pressure hydraulic fluid to migrate toward the centerline 40 between the roller 22 and the roller bearing surface 30 during the transition of high pressure to low pressure. The fluid that is trapped in the gap 74 can provide lubrication between the roller 22 and the bearing surface 30, which allows the roller 22 to rotate freely just after the peak of the external tooth 24 of the rotor 8 is no longer in contact with the roller 22 at the centerline 40.

In the illustrated embodiment, the roller bearing surface 30 follows the first radius r1 from the first pocket edge 54 to adjacent where the centerline 40 intersects the bearing surface 30. Similarly, the roller bearing surface 30 follows the second radius r2 from the second pocket edge 56 to adjacent where the centerline 40 intersects the bearing surface. The two different radii r1, r2 that are slightly larger than the ½ the diameter Dr of the roller 22 allow for slight movement of the roller 22 with respect to the roller bearing surface 30. This facilitates the entry of hydraulic fluid to the area between the roller 22 and the roller bearing surface 30. The pocket 18 being shaped in a manner that the maximum pocket width Pw is smaller than the diameter Dr of the roller 22 limits the movement of the roller with respect to the roller bearing surface 30, which can be desirable. The two different radii r1, r2 each being slightly offset from the centerline 40 of the pocket 18 can allow the bearing surface 30 to surround more than 180 degrees of the roller 22, which can allow for a smaller diameter roller and can also protect against wear at the pocket edge 54, 56. The two different radii r1, r2 can also obviate the need for complicated lands and recesses to be formed in the bearing surface 30 to facilitate the distribution of fluid along the bearing surface between the roller 22 and the roller bearing surface. However, the bearing surface 30, as seen in FIG. 5, can include a notch 80 where the centerline 40 intersects the bearing surface 30. The notch 80 is interposed between the first side 50 and the second side 52 of the bearing surface 30. The notch 80 is where the bearing surface 30 deviates from the radii r1, r2 of the remainder of the bearing surface 30 outside of the notch. The notch 80 can be very small, e.g. a 0.0002 inches gap is provided between the bearing surface 30 at the notch 80 and the roller 22. As shown in FIG. 4, the notch 80 is centered with respect to the roller pocket 18.

The roller pockets 18 in the stator 10 can be manufactured using the process described in PCT/US2012/40835, which is incorporated by reference herein.

A stator for a gerotor device has been described above with particularity. Modifications and alterations will occur to those upon reading and understanding the preceding detailed description. The invention, however, is not limited to only the embodiments described above. Instead, the invention is broadly defined by the appended claims and the equivalents thereof

The invention claimed is:

1. A gerotor device including a rotor having outwardly extending teeth and a stator having inwardly extending teeth, wherein the inwardly extending teeth are formed by rollers each of which having a diameter and being received in a respective roller pocket in the stator, wherein the rotor forms pressure chambers with the rollers, wherein each roller pocket defines a roller bearing surface that follows a first radius from a first pocket edge where the pocket transitions to a central cavity in the stator to adjacent where a pocket centerline intersects the roller bearing surface and that follows a second radius from a second pocket edge where the pocket transitions to the central cavity in the stator to adjacent where the centerline intersects the bearing surface, wherein each radius is greater than ½ the diameter of the roller.

2. The gerotor device of claim 1, wherein each roller pocket has a maximum pocket width measured perpendicular to a pocket centerline, and each roller pocket has an edge pocket width measured parallel with the maximum pocket width between the first pocket edge and the second pocket edge, wherein the edge pocket width is less than the maximum pocket width.

3. The gerotor device of claim 2, wherein the edge pocket width is less than the diameter of the respective roller received in the roller pocket.

4. The gerotor device of claim 1, wherein each roller pocket surrounds the respective roller received therein more than 180 degrees around the respective roller.

5. The gerotor device of claim 1, wherein the diameter of the roller and each radius of the roller pocket is dimensioned such that the roller contacts the roller bearing surface at two contact points when the rotor is at top dead center with respect to the respective roller.

6. The gerotor device of claim 1, wherein the first radius is equal to the second radius.

7. A gerotor device including a rotor having outwardly extending teeth and a stator having inwardly extending teeth, wherein the inwardly extending teeth are formed by rollers each of which is received in a respective roller pocket in the stator, wherein the rotor forms pressure chambers with the rollers, wherein each roller pocket has a maximum pocket width measured perpendicular to a pocket centerline, wherein each roller pocket defines a roller bearing surface having a first side that follows a first radius and a second side on an opposite side of the centerline that follows a second radius, wherein each radius is greater than ½ the maximum pocket width, wherein each roller pocket has an edge pocket width measured parallel with the maximum pocket width between a first pocket edge where the pocket transitions to a central cavity in the stator and a second pocket edge where the pocket transitions to the central cavity in the stator on an opposite side of the centerline, and the edge pocket width is less than the maximum pocket width.

8. The gerotor device of claim 7, wherein each roller pocket surrounds the respective roller received therein more than 180 degrees around the respective roller.

9. The gerotor device of claim 8, wherein the edge pocket width is less than the diameter of the respective roller received in the roller pocket.

10. The gerotor device of claim 9, wherein the diameter of the roller and each radius of the roller pocket is dimensioned such that the roller contacts the roller bearing surface at two contact points when the rotor is at top dead center with respect to the respective roller.

11. The gerotor device of claim 10, wherein the first radius is equal to the second radius.

12. The gerotor device of claim 11, wherein the roller bearing surface follows the first radius from the first pocket edge to adjacent where the centerline intersects the bearing surface and the roller bearing surface follows the second radius from the second pocket edge to adjacent where the centerline intersects the bearing surface.

13. The gerotor device of claim 12, wherein the roller bearing surface includes a notch where the centerline intersects the bearing surface.

* * * * *